US006171073B1

(12) United States Patent
McKain et al.

(10) Patent No.: US 6,171,073 B1
(45) Date of Patent: Jan. 9, 2001

(54) FLUID VACUUM SAFETY DEVICE FOR FLUID TRANSFER AND CIRCULATION SYSTEMS

(76) Inventors: Paul C. McKain, 3300 NW. 9th Ave., Sunrise, FL (US) 33351; David Rizzi, 9610 SW. 56 Terrace, Miami, FL (US) 33173; Mark Fritze, 558 Lakeside Cir., Sunrise, FL (US) 33326

( * ) Notice: Under 35 U.S.C. 154(b), the term of this patent shall be extended for 0 days.

(21) Appl. No.: 09/357,036

(22) Filed: Jul. 20, 1999

Related U.S. Application Data

(63) Continuation-in-part of application No. 08/901,849, filed on Jul. 28, 1997, now Pat. No. 5,947,700.

(51) Int. Cl.[7] ..... F04B 49/00
(52) U.S. Cl. ..... 417/306; 417/300; 417/541.2
(58) Field of Search ..... 417/306, 300, 417/63, 17, 44.9, 541.2

(56) References Cited

U.S. PATENT DOCUMENTS 4,602,391 * 7/1986 Shepherd ..... 417/541.4
5,167,041 * 12/1992 Burkitt, III ..... 417/541.2
5,499,406 * 3/1996 Chalberg et al. ..... 417/541.2
5,570,481 * 11/1996 Mathis et al. ..... 417/541.2
5,682,624 * 11/1997 Ciochetti ..... 417/509
5,725,359 * 3/1998 Dongo et al. ..... 417/44.9
5,947,700 * 9/1999 McKain et al. ..... 417/306

* cited by examiner

*Primary Examiner*—Teresa Walberg
*Assistant Examiner*—Vinod D Patel
(74) *Attorney, Agent, or Firm*—Robert M. Downey, P.A.

(57) ABSTRACT

A safety device for use in a fluid transfer and/or circulation system of the type which uses a pump to draw water from a reservoir through one or more intake lines each extending from an open end at the reservoir to the pump intake. The safety device connects in-line with the fluid transfer/circulation system, between the open ends of the intake lines and the pump and includes a vacuum pressure sensor, an analyzer and controller, a relay, and a vacuum breaker. Each time the pump is activated, the device analyzes negative pressure levels throughout a start-up period to establish a normal operating pressure window for the particular system. If the negative pressure level deviates beyond a pre-set maximum high-low range during the start-up period, or if, once the normal operating pressure window has been established, the device senses negative pressure levels being outside (high or low) of the normal operational range during operation of the system, the controller trips the relay to deactivate the pump motor and triggers the vacuum breaker to eliminate negative pressure in the system by introducing air from atmosphere into the intake lines, thereby removing suction at the open ends of the intake lines. The safety device may further activate warning devices including audible and visible alarms to indicate that the system has been deactivated.

20 Claims, 5 Drawing Sheets

FLUID VACUUM SAFETY DEVICE FOR FLUID TRANSFER AND CIRCULATION SYSTEMS

This application is a continuation-in-part of patent application Ser. No. 08/901,849 filed on Jul. 28, 1997. Now U.S. Pat. No. 5,947,700 issued Sep. 7, 1999

BACKGROUND OF THE INVENTION

1. Field of the Invention

The present invention relates to a safety device for fluid transfer systems and, more particularly, to a safety device for eliminating vacuum pressure in the system upon detecting a change in the negative pressure levels in the system that deviates beyond a predetermined operational range, thereby removing a suction force at open ends of intake lines in the system.

2. Description of the Related Art

Drowning is the second leading cause of unintentional injury related deaths to children 14 years old and younger. Most drownings occur in swimming pools and hot tubs, and in many incidents (involving both adults and children) the main culprit is the water circulation system. In a typical pool, the circulation system includes a main drain suction intake line and at least one skimmer suction intake line, both of which feed into a main intake line that leads to a pump. A return line directs water flow back into the pool.

Most people do not feel threatened by a pool's circulation system, including the main drain intake on the bottom of the pool, and the skimmer boxes along the side of the pool. However, if a person comes into contact with any of the suction intake lines of the circulation system (at either the main drain or skimmer intakes) causing the suction intake to be covered or obstructed, the immense suction of the pump forms an instant seal between the open end of the suction intake line and the person's skin or clothing. This may result if a person places their hand over the open end of the suction intake line or, as often happens with children, a person sits down on the suction intake. In either case, the force needed to pull them free often exceeds 800 pounds. Moreover, the injuries which are inflicted in a matter of a few seconds are horrific, usually permanent and sometimes fatal. If a person, especially a child, is sucked onto the main drain suction intake on the bottom of the pool, they usually drown.

The only way to free a person sucked onto the intake of a circulation system of this type, without causing severe injury or dismemberment, is to interrupt or disable the source of the suction force, i.e., the pump. This can be done by interrupting power to the pump. However, even if the pump is shut down, a vacuum can remain in the intake side of the system between the pump and the obstructed end of the suction intake line. Sometimes, a victim could still be freed with some assistance, although serious injury or death may result. Ideally, if the vacuum in the intake line can be quickly eliminated after a victim becomes stuck to the intake, the victim will be freed with little or no assistance and without injury.

In most instances wherein a victim becomes stuck to an intake of a circulation system, typically in a swimming pool or hot tub, rescuers fail to realize the need to immediately shut off the pump. Instead, in a panic, people tend to go to the victim and attempt prying them free. In the rare instance this is successful, the injuries are often severe and permanent. Of course, there are also instances wherein there are no other people present to come to the victim's rescue. These situations are almost always fatal.

The imminent danger presented by fluid circulation systems of the type commonly found in swimming pools, hot tubs, and the like has been longstanding in the art. Little, if any, attention has been given to providing a satisfactory solution to this deadly problem that exists in every swimming pool, hot tub, as well as all other fluid circulation systems wherein a fluid is drawn from a reservoir through one or more suction intakes by a pump. Accordingly, there has been and there remains an urgent need to provide an effective means of preventing death and injury to those otherwise unfortunate victims who become unexpectedly attached by suction to the intake of a fluid circulation system.

SUMMARY OF THE INVENTION

The present invention is directed to a device for use in a fluid transfer and/or circulation system of the type including at least one pump which draws water from a reservoir through one or more intake lines each extending from an open end at the reservoir to an intake of the pump. The primary purpose of the invention is to save lives and property by alleviating the intense vacuum that builds when one or more of the suction intake ports of a pump assisted fluid circulation system becomes obstructed. The safety device includes means for sensing negative pressure levels in the fluid transfer/circulation system and means for analyzing the sensed negative pressure levels. Each time the pump is activated, the safety device analyzes negative pressure levels throughout a start-up period in order to establish a normal operating negative pressure range or window for that particular system. During the start-up period, if the negative pressure level fails to stabilize (e.g., vacuum pressure rises beyond a predetermined maximum high or drops below a predetermined low level) within a predetermined operational range which is programmed in the device, the device triggers vacuum pressure relief means and disables the pump. Otherwise, once the normal operating negative pressure window has been established, following a normal start-up, if the device detects a deviation of the negative pressure level outside of a normal operational range, the vacuum pressure relief means are actuated in order to eliminate negative pressure in the system, thereby removing suction at the open ends of the intake lines. The device also disables the pump, shutting it off, upon detecting the abnormal negative pressure level. In the event there is an absence of negative pressure due to lack of fluid movement (e.g., broken pipes, reservoir dry, etc.), the device triggers the vacuum pressure relief means and disables the pump, thereby preventing damage to the system. Warning devices, including audible and visible alarms, may be provided to indicate that operation of the fluid transfer system has been interrupted. This is especially useful to alert users to the possible occurrence of an obstruction of the intake lines by a person or object and the need to inspect and reset the device prior to reactivating the fluid transfer system. Other options can also be integrated with the device, including remote audible alarms, visual indicators, a remote panic switch, and the like.

OBJECTS AND ADVANTAGES OF THE INVENTION

With the foregoing in mind, it is a primary object of the present invention to provide a safety device for use in a fluid transfer/circulation system, wherein the device is structured to eliminate negative pressure in the system upon detecting a negative pressure level being outside of a selected operational range, thereby removing suction at the open ends of the intake lines.

It is a further object of the present invention to provide a safety device which is particularly useful in the fluid circulation systems of swimming pools, hot tubs and the like for preventing death and injury to persons or animals which become attached by suction to the intake openings of the system.

It is still a further object of the present invention to provide a safe, reliable and relatively inexpensive safety device for easy installation to existing fluid transfer/circulation systems and which automatically adjusts to any system, each time the fluid begins to flow, thereby establishing a normal operating range for each system, and wherein the device is structured to eliminate negative pressure in the system upon detecting a negative pressure level being outside (high or low) of a predetermined maximum range or the established normal operating range, thereby removing suction at the open ends of the intake lines.

It is still a further object of the present invention to provide a reliable, relatively inexpensive safety device for use in a fluid transfer/circulation system of the type including at least one pump which draws water from a reservoir through one or more intake lines, wherein the device is structured to deactivate the pump(s) and to further eliminate negative pressure in the system upon detecting a predetermined negative pressure level in the system being outside of a predetermined range.

It is still a further object of the present invention to provide a safety device, as described above, that is structured to readjust to a new operational pressure level within a predetermined maximum high/low negative pressure range, each time the fluid transfer/circulation system is activated.

It is still a further object of the present invention to provide a safety device, as described above, that is structured to open and close a vacuum breaker upon start-up of the pump of the fluid transfer/circulation system, thereby introducing air into the system in order to eliminate start-up pressure spikes created by initial movement of a water column in the system, and allowing the safety device to differentiate water column movement and an obstructed opening of the fluid transfer/circulation system.

It is still a further object of the present invention to provide a safety device, as described above, further including warning devices such as, but not limited to, audible and visible alarms, to indicate that the safety device has been triggered to eliminate negative pressure in the intake lines of a fluid transfer system.

It is still a further object of the present invention to provide a safety device, as described above, that performs all of the above-stated functions in a completely automated, self-adjusting manner, and wherein all functions are controlled by a microprocessor, thereby eliminating any manual controls.

It is still a further object of the present invention to provide a safety device, as described above, which is contained in a totally sealed, compact unit for convenient, easy installation in-line with any fluid transfer/circulation system.

These and other objects and advantages of the present invention are more readily apparent with reference to the following detailed description taken in conjunction with the accompanying drawings.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

The present invention is directed to a fluid vacuum safety device 50 for use in a pump assisted fluid circulation system for the purposes of alleviating an intense vacuum that builds in the system when one or more of the suction intake ports of the circulation system become obstructed.

Figure 6:
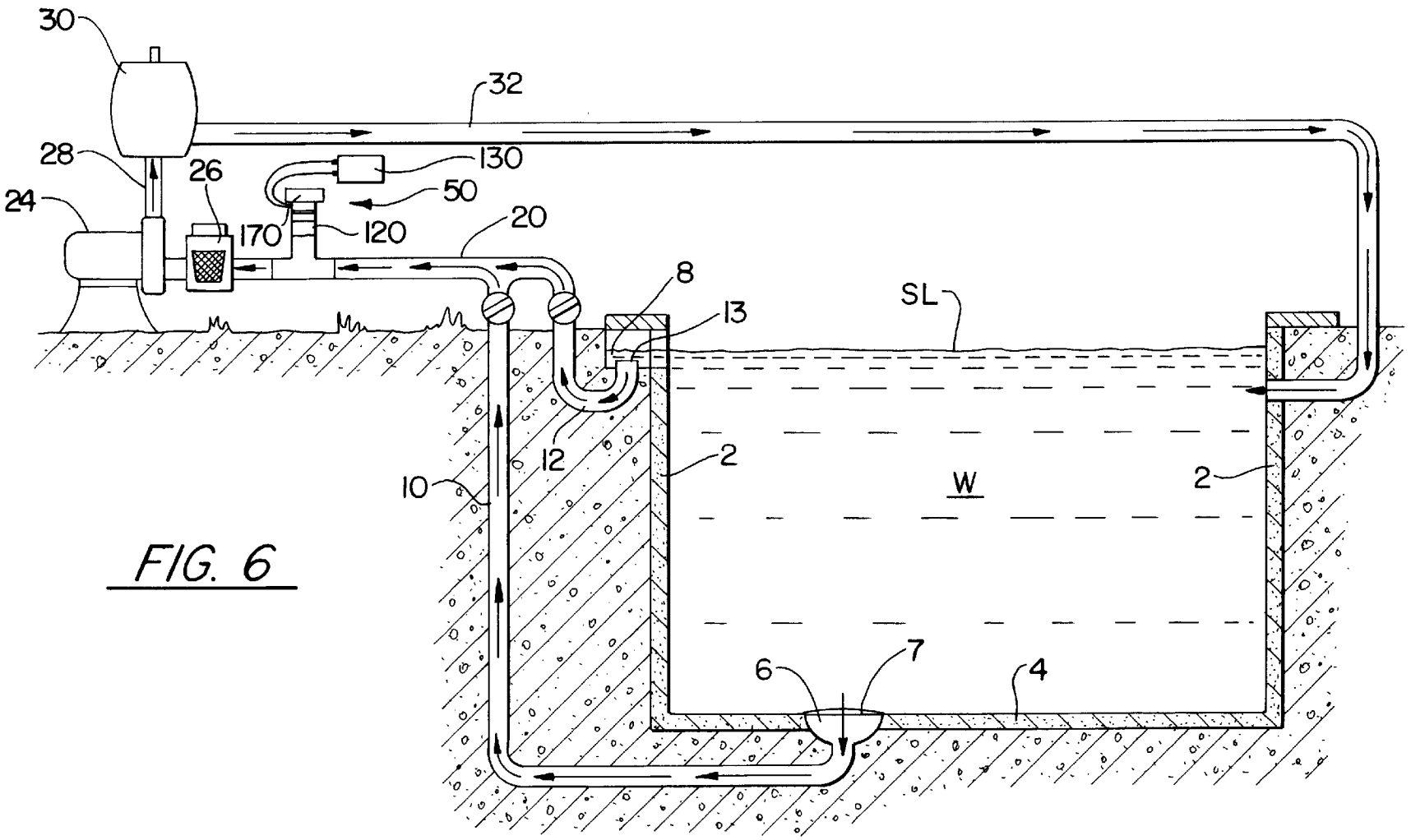
FIG. 6 is an elevational view, in partial section, illustrating a typical fluid circulation system for circulating fluid in a reservoir, such as a swimming pool, hot tub or the like, showing the safety device of the present invention installed in-line on a main suction intake line of the system, between the intake of the system's pump and suction intake openings in the swimming pool.

Referring to FIG. 6, a typical fluid circulation system of the type commonly found in swimming pools and hot tubs is shown. A reservoir of water W is contained within a structure having side walls 2 and a bottom 4. A main drain 6 having a drain cover grating is provided on the bottom 4. At least one skimmer box 8 is provided along one or more of the side walls 2 at the water surface level SL. A drain suction intake line 10 leads from the main drain 6 to a main suction intake line 20. A skimmer suction intake line 12 has an open end 13 in the skimmer box 8 which is maintained below the water surface level SL. The skimmer suction intake line 12 feeds into the main intake line 20. The main intake line 20 is directed to a pump 24 which may have a screen trap 26 connected to the main intake line 20, just prior to the intake of the pump 24. A main output line 28 leads to a filter 30. One or more return lines 32 extend from the filter 30 back to the water reservoir W to return water that is circulated through the system back to the reservoir W.

FIG. 6 shows the fluid vacuum safety device 50 properly installed in-line along the main suction intake line 20 of the circulation system, prior to the intake of the pump 24 and screen trap 26. If an object or person is caused to be sucked onto one of the open ends of the suction intakes, such as the open end 13 of the skimmer suction intake 12, the drain plate 7 or, if the drain plate is removed, the drain suction intake line 10 at the main drain 6, a vacuum will instantly develop throughout the intake lines, including the main suction intake line 20. The fluid vacuum safety device 50 is designed to react to this situation to immediately eliminate the vacuum in the system and, accordingly, the suction force at the open ends of each of the suction intake lines, including the skimmer suction intake 13 and the main drain intake 6.

Upon reaching a predetermined vacuum level, which happens quite rapidly when one of the intakes becomes obstructed, the fluid vacuum safety device 50 causes air from atmosphere to be rapidly introduced into the main intake line 20 and throughout the other intake lines, thereby removing all suction force at the open suction intake ends 13 and 6 in the reservoir W. The air introduced into the system interrupts the prime of the pump 24, thereby eliminating any further source of suction.

Figure 1:
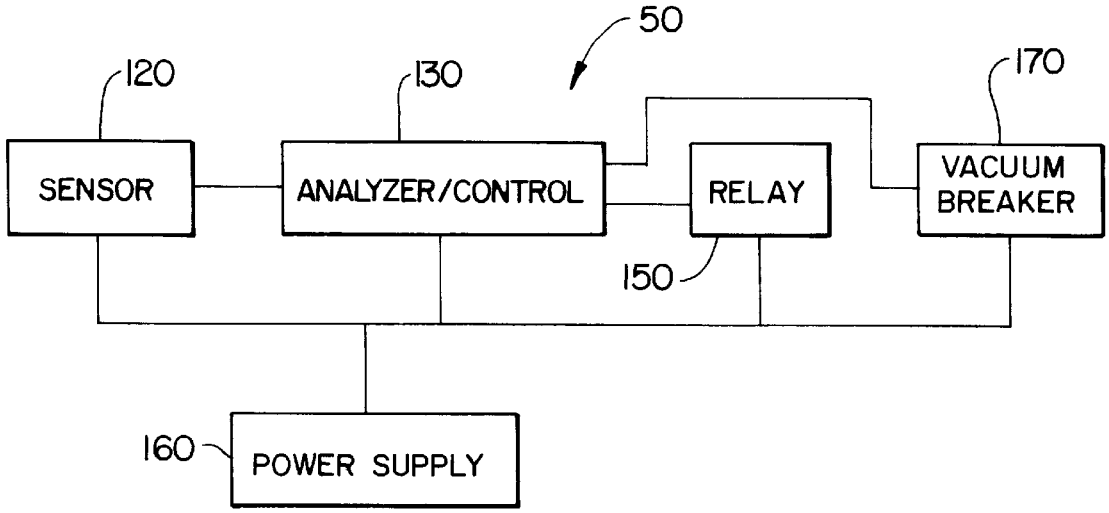
FIG. 1 is a schematic block diagram of the primary components of the safety device in accordance with a preferred embodiment of the present invention.

Referring now to FIG. 1, the principal components of the fluid vacuum safety device 50 are shown in block diagram form. Specifically, the principal components of the fluid vacuum safety device 50 include a sensor circuit 120 which senses the vacuum pressure level in the fluid circulation system. The output of the sensor circuit 120 is applied to an analyzer/control circuit 130 that allows selective setting (programming) of a particular negative pressure range (a predetermined high and low vacuum pressure level) which thereby defines a trip point (high or low) or emergency condition in the system. The output of the analyzer/control circuit 130 controls operational relays or contactors 150 to interrupt power to the pump 24 and triggers a vacuum breaker 170 upon detecting the trip point. In the preferred embodiment, the analyzer/control 130 is a programmable microprocessor and vacuum breaker 170 is a solenoid controlled valve. A power supply 160 furnishes voltage for the circuitry. The sensor 120 utilizes a strain gauge to sense the vacuum in the pump return line 20. The sensor 120 converts vacuum pressure to voltage readings. Changes in voltage readings correspond directly to vacuum pressure level changes in the system. The voltage readings are amplified in the sensor and sent to the analyzer/control 130 for processing.

Figure 2:
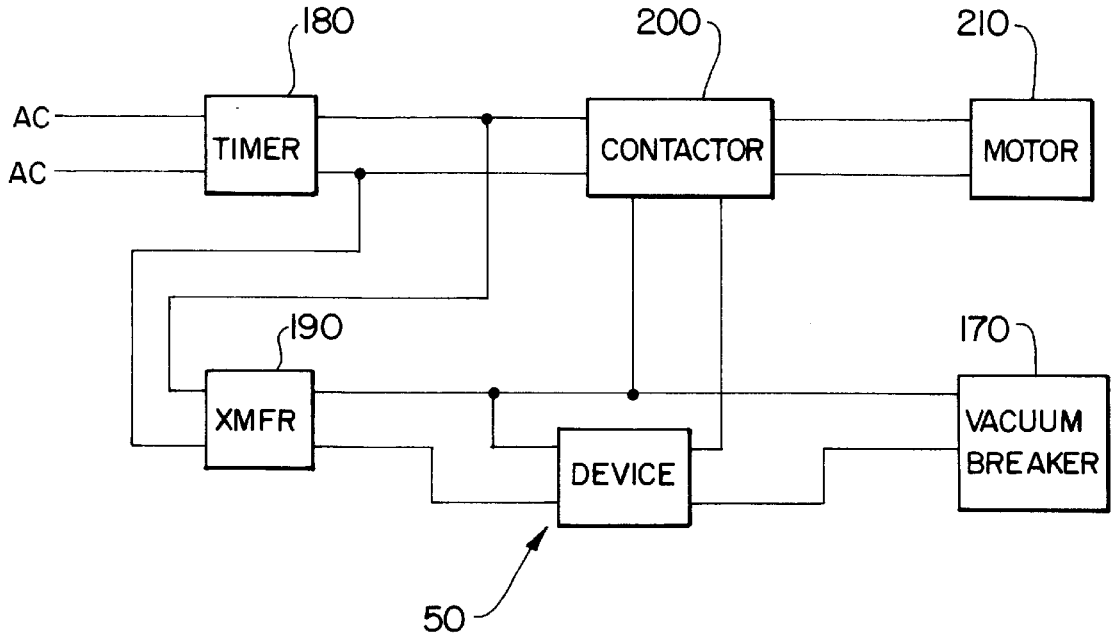
FIG. 2 is a schematic block diagram of the safety device installed in a fluid transfer/circulation system.
Figure 3:
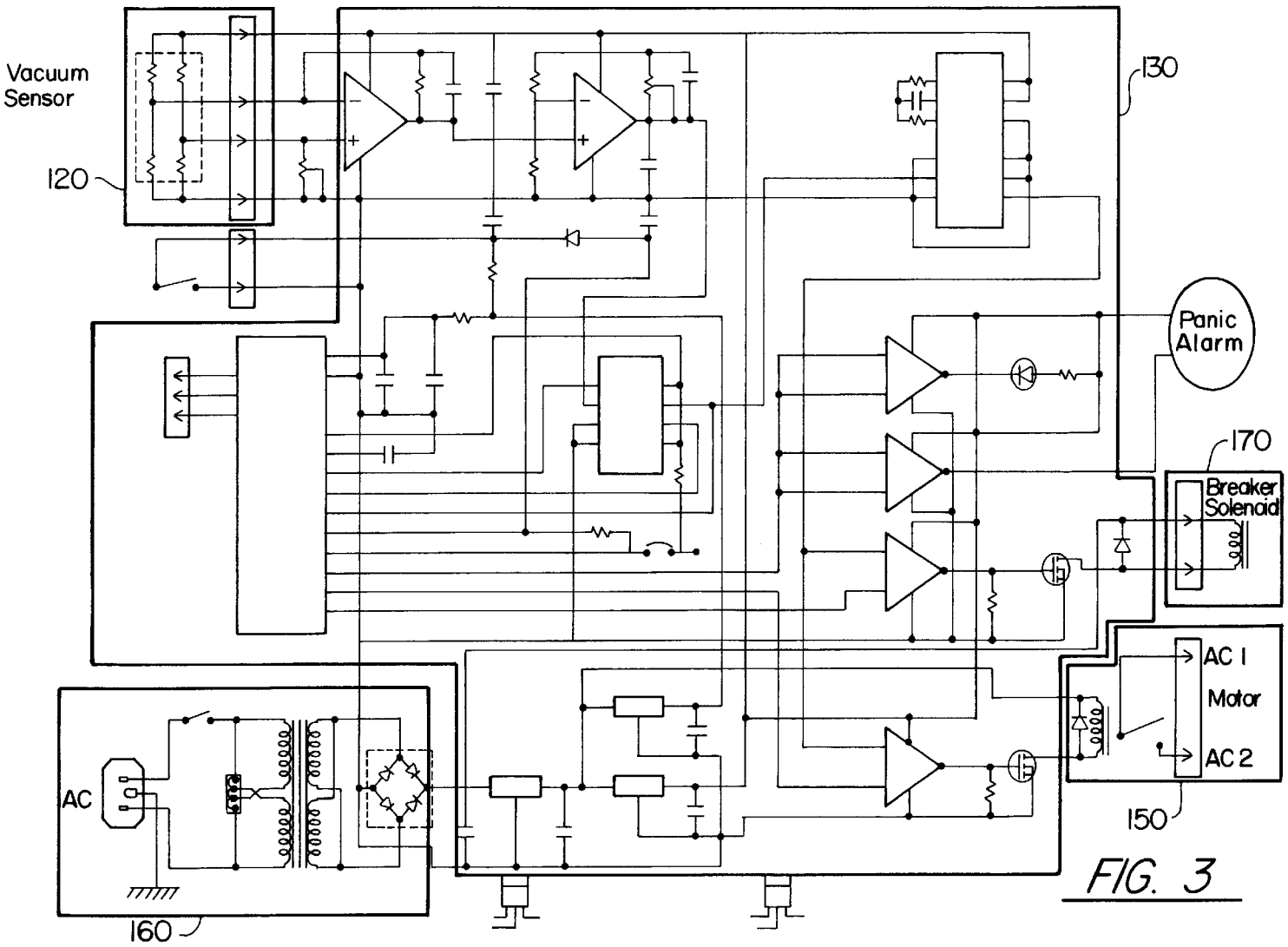
FIG. 3 is a circuit diagram of the safety device.
Figure 4:
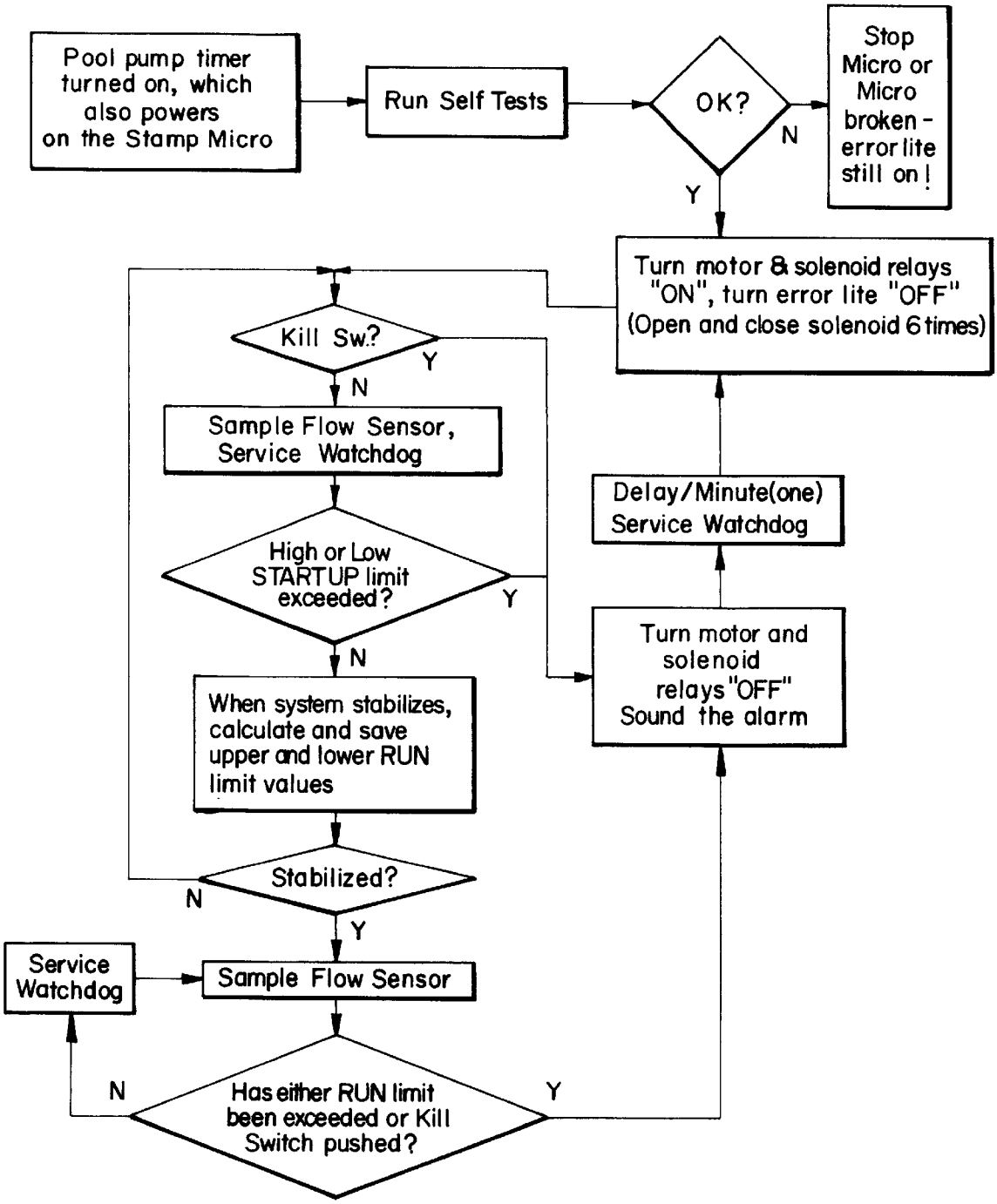
FIG. 4 is a flow chart illustrating a sequence of steps or a programmed manner of operation of the safety device, in accordance with one preferred embodiment thereof.

Referring to FIG. 2, a block diagram shows the device 50 installed, along with the vacuum breaker 170, to a fluid circulation system. The diagram of FIG. 2 is representative of a preferred configuration of components for use in the fluid circulation system of swimming pools and hot tubs. In FIG. 2, the fluid vacuum safety device 50 (incorporating the sensor 120, analyzer/control 130 and relay 150) is shown wired to the vacuum breaker 170 and other components of the fluid circulation system. When the timer 180 of the system goes active, power is applied to the transformer 190, which supplies low voltage AC to the safety device 50. One side of the low voltage AC is also supplied to the contactor 200 and the vacuum breaker 170. Unless a problem is detected by the analyzer/control 130, the low voltage AC circuit will be completed to the contactor 200 which will allow the motor 210 of the pump 24 to run. Upon initial start-up of the pump and motor of the fluid circulation system, the sensor 120 must register a change in millivolts (e.g., a 10–15 millivolt change), otherwise the device will identify the lack of change as a dry system (no water flow) which may be caused by a broken pipe or other problem in the system. If the minimum pressure change is not sensed by the sensor 120, the analyzer/control (microprocessor) 130 triggers the relay 150 to interrupt power to the pump motor 210 in order to deactivate the motor 210 and pump 24 in the system, thereby preventing damage to these and other components. After a time-out period, the analyzer/control 130 closes the circuit to the motor 210 and again checks for a rise in negative pressure. If no change in pressure is registered, the device shuts the system down again and repeats this cycle until the timer 180 of the system eventually times out. Thus, each time the pump starts up, the analyzer/control 130 looks for an initial rise in vacuum pressure in the system, from zero. If conditions are normal (i.e., an initial negative pressure rise is detected), the analyzer/control 130 looks for a constant running vacuum pressure in the system throughout a pump start-up. If, after the start-up period is complete, the analyzer/control 130 detects a constant running pressure in the system, the device 50 assumes an armed state and continues to monitor operating conditions.

Figure 5:
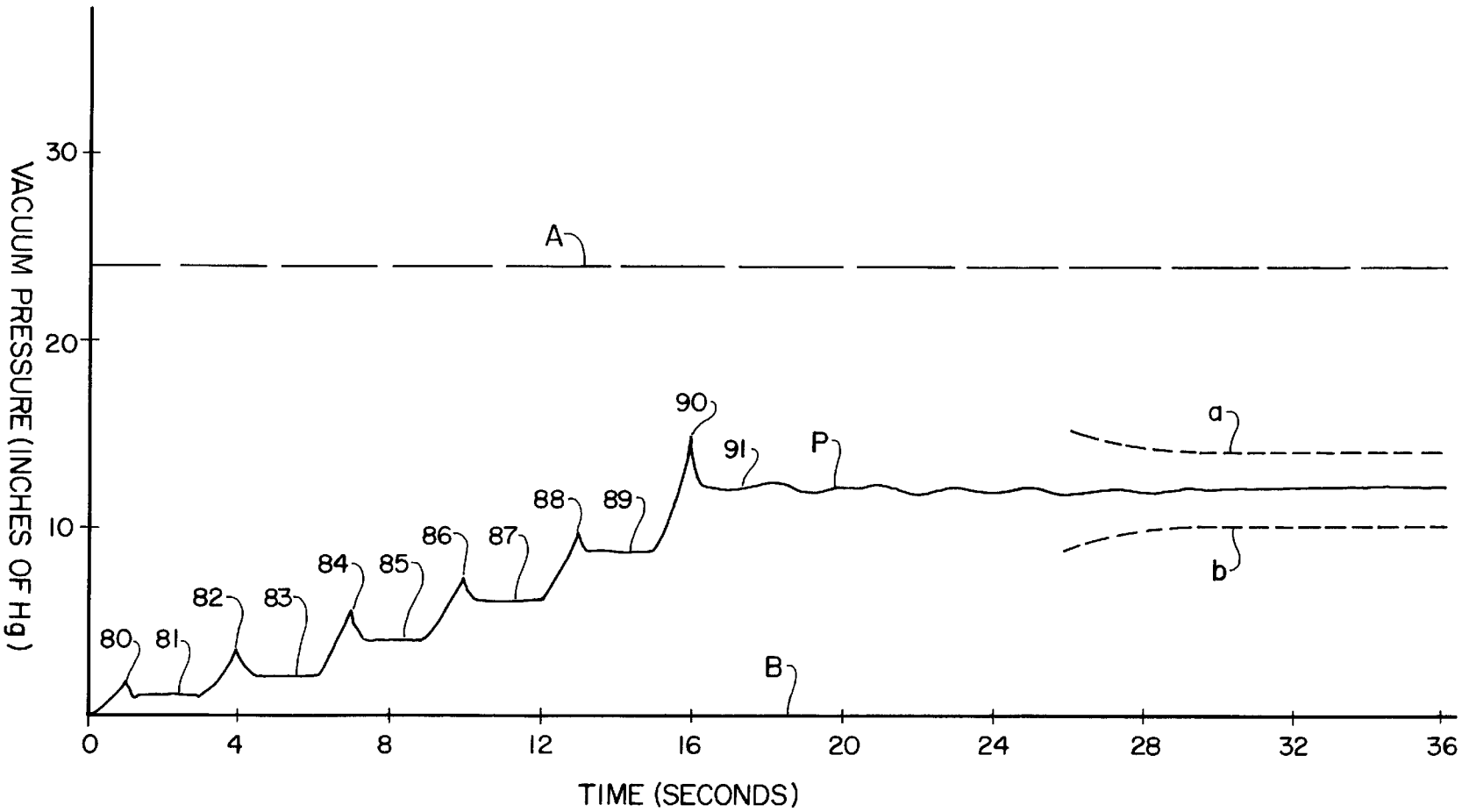
FIG. 5 is a graph showing the adjustment by the safety device to the operating pressure of the fluid transfer/circulation system during the start-up period to establish a normal operational pressure range within a predetermined maximum high/low range.

Referring to FIG. 5, the rise in vacuum pressure in the fluid circulation system is shown during the initial pump start-up period, as the device 50 monitors and controls the system. In particular, the device 50 is structured to cushion the initial water hammer that results when the pump is first activated, wherein a column of water within the pipes of the system begins to move. Ordinarily, the initial movement of this column of water results in a "high spike" of negative pressure. Without controls to cushion this initial "high spike," the device would be triggered to shut down the pump. To avoid this problem, the device 50 is specifically structured to cushion the initial "high spike" pressure upon initial pump start-up. More specifically, referring to FIG. 5, the analyzer/control 130 actuates the vacuum breaker 170, to open and close the vacuum breaker several times (e.g. 5–6 times) during the first 12–20 seconds of the start-up period. As seen by the movement of negative pressure P in the graph of FIG. 5, the vacuum breaker is first opened after approximately one second from initial pump start-up, causing air to be introduced into the system. The vacuum breaker is maintained open for approximately two seconds. This results in a slight rise and peak of pressure, as indicated as 80, followed by a drop and plateau 81 for the following two seconds. Throughout approximately the first 16–18 seconds of the start-up period in the example of FIG. 5, the analyzer/control 130 opens and closes the vacuum breaker 170 in a series of cycles, causing a "stair-step" effect in the rise in negative pressure, as seen by the peaks 82, 84, 86, 88 and 90 followed by the plateaus 83, 85, 87, 89 and 91. This stair-step effect helps to eliminate the initial high spike of vacuum pressure so that the pressure remains below a programmed maximum high level of negative pressure A, above which the device will be triggered to deactivate the pump and open the vacuum breaker. If an obstruction were to occur during the start-up period, the pressure would rise above the pre-selected maximum high pressure level A, at which point the analyzer/control would trip the relay 150 to deactivate the pump. The analyzer/control 130 would further trigger the vacuum breaker 170 to eliminate negative pressure in the system by introducing air from atmosphere into the intake lines, thereby removing suction at the open ends of the intake lines. If, on the other hand, the start-up period is normal and the pressure P stabilizes after the plateau 91 of the last opening and closing of the vacuum breaker during the start-up period, then, after an additional ten seconds, the device will establish a normal operating pressure range (window) as indicated by the broken lines a–b in FIG. 5. At this point, the device 50 is in an armed state. Thereafter, the device 50 continues to monitor conditions in the fluid circulation system. If the operating pressure P, at any time, begins to deviate outside of the window a–b, either high or low, the analyzer/control 130 will trip the relay 150 to deactivate the pump. Simultaneously, the analyzer/control 130 triggers the vacuum breaker 170 to eliminate negative pressure in the system by introducing air from atmosphere from the intake lines, thereby removing suction, almost instantaneously, at the open ends of the intake lines. The device 50 can be programmed to cycle through a time-out period, after being triggered, at which time, the analyzer/control 130 will attempt to re-acquire a normal operating pressure range, once the pump and motor have been reactivated. If, after restarting the system, a normal operating pressure is sensed (i.e., a constant running vacuum pressure below the maximum high vacuum pressure setting A is established), the device 50 will assume the armed state and continue operation and monitoring of the fluid circulation system. With the incorporation of additional contacts, other indicators and/or warning devices can be added to the device 50.

Accordingly, the device operates within both a pre-programmed or set maximum high and low vacuum pressure range A–B as well as a normal operating vacuum pressure range a–b for each system which is established each time the pump is started.

During the initial start-up period, before the device assumes the armed state, the analyzer/control 130 monitors pressure within the pre-set range A–B. If during the initial period, prior to establishing the normal operating window a–b, vacuum pressure in the system drops to B or goes above A, the analyzer/control 130 triggers the relay 150 and vacuum breaker 170 to stop operation of the pump and motor and to release vacuum in the system. Otherwise, once the stair-step cushioning effect has been completed and the pressure P stabilizes, the analyzer/control establishes the normal operating pressure window a–b and the device becomes armed. Thereafter, any deviation of the monitored pressure P outside of this window a–b will result in analyzer/control 130 triggering the relay and vacuum pump, stopping the pump and motor and simultaneously releasing vacuum in the system.

The device 50 is further provided with a watch dog circuit incorporated within the analyzer/control circuitry. The watch dog circuit is a type of timer which monitors the analyzer/control (microprocessor) output and is structured to shut down the motor 210 of the pump 24 in case of a failure of the analyzer/control 130. The watch dog circuit may also be configured to trigger the vacuum breaker 170 is analyzer/control failure is determined.

The device 50 may further be provided with switch means or control means for adjusting the maximum high vacuum pressure level A to each fluid circulation system. This will permit raising or lowering of the maximum high vacuum pressure level so that it is close to the high pressure level (a) of the normal operating vacuum pressure window for each particular system. This serves to limit the vacuum pressure ceiling or high limit during the pump start-up period, beyond which the device will be triggered. Jumpers or a switch are also provided to facilitate moving the pre-set high vacuum pressure limit A between a pool operating mode, wherein the limit A would be higher, and a spa operating mode, wherein the high limit A would be lower than that of the pool mode.

While the instant invention has been shown and described in accordance with preferred embodiments thereof, representing a best mode of the invention at the time of filing of the application for patent, it is recognized that variations, modifications and changes may be made to the instant disclosure without departing from the spirit and scope of the invention, as set forth in the following claims and within the doctrine of equivalents.

What is claimed is:

1. A device for use in a fluid transfer or fluid circulation system having a pump which draws water from a reservoir through one or more intake lines each extending from an open end at the reservoir to an intake of the pump;

said device comprising:

means for sensing negative pressure levels in the system;

means for establishing an operational range of negative pressure levels between a maximum operational negative pressure level and a minimum operational negative pressure level;

means for determining if the sensed negative pressure levels deviate outside of the operational range of negative pressure levels;

means for interrupting operation of the pump; and vacuum pressure relief means for introducing positive pressure to the one or more intake lines of the system upon actuation thereof to thereby eliminate suction at the open ends of the one or more intake lines, said vacuum pressure relief means being actuated in response to a sensed negative pressure level being outside of the operational range.

2. The device as recited in claim 1 wherein said means for determining include:

means for analyzing the sensed negative pressure levels including means for comparing the sensed negative pressure levels to the established operational range of negative pressure levels to determine if the sensed negative pressure levels deviate outside of the established operational range of negative pressure levels; and control means for triggering actuation of said vacuum pressure relief means and said means for interrupting operation of the pump upon said analyzing means determining that a sensed negative pressure level is outside of the established operational range of negative pressure levels.

3. The device as recited in claim 2 wherein said vacuum pressure relief means includes a vacuum breaker structured and disposed to introduce air from atmosphere into the one or more intake lines of the system upon actuation thereof.

4. The device as recited in claim 3 wherein said vacuum breaker includes a solenoid controlled valve.

5. The device as recited in claim 2 wherein said analyzing means and said control means include a programmable microprocessor.

6. The device as recited in claim 5 wherein the pump of the system is driven by an electric motor and wherein said means for interrupting operation of the pump includes relay means communicating with said control means and being operated by said control means to selectively direct and interrupt electric current flow to the electric motor.

7. The device as recited in claim 6 wherein said means for establishing includes:

means for determining a normal operating pressure level of the system; and means for establishing a normal operating pressure range defining said operational range of negative pressure levels.

8. The device as recited in claim 7 wherein said means for establishing further includes:

means for selecting said maximum operational negative pressure level and said minimum operational negative pressure level.

9. The device as recited in claim 8 wherein said means for selecting includes means for programming said maximum operational negative pressure level and said minimum operational negative pressure level in said analyzing means.

10. The device as recited in claim 9 further comprising:

means for cushioning a rise in negative pressure levels in the system during a start-up period of the system wherein the pump is actuated and fluid begins to flow in the system, thereby preventing a surge of negative pressure in the system beyond said maximum operational negative pressure level caused by the initial movement of fluid through the system.

11. A device for use in a fluid transfer or fluid circulation system having a pump which draws water from a reservoir through one or more intake lines each extending from an open end at the reservoir to an intake of the pump;

said device comprising:

means for sensing negative pressure levels in the system;

means for establishing a first operational range of negative pressure levels between a maximum operational negative pressure level and a minimum operational negative pressure level;

means for establishing a second operational range of negative pressure levels each time the pump is activated to cause movement of water through the system, said second operational range defining a normal operating pressure window;

means for analyzing the sensed negative pressure levels in relation to the established first and second operational ranges to determine if the sensed negative pressure levels deviate outside of the first or second operational ranges;

means for interrupting operation of the pump in the system;

vacuum pressure relief means for introducing positive pressure into the intake lines of the system to thereby eliminate suction at the open ends thereof, said vacuum pressure relief means being actuated in response to detection of a sensed negative pressure level being outside of the first or second operational ranges; and control means communicating with said sensing means, said analyzing means and said vacuum pressure relief means for triggering actuation of said vacuum pressure relief means and said means for interrupting operation of the pump upon said analyzing means determining that a sensed negative pressure level is outside of the first or second operational range.

12. The device as recited in claim 11 wherein said vacuum pressure relief means includes a vacuum breaker structured and disposed to introduce air from atmosphere into the one or more intake lines of the system upon actuation thereof.

13. The device as recited in claim 12 wherein said vacuum breaker includes a solenoid controlled valve.

14. The device as recited in claim 13 wherein said analyzing means and said control means include a programmable microprocessor.

15. The device as recited in claim 14 wherein the pump of the system is driven by an electric motor and wherein said means for interrupting operation of the pump includes relay means communicating with said control means and being operated by said control means to selectively direct and interrupt electric current flow to the electric motor.

16. The device as recited in claim 15 wherein said means for establishing further includes:

means for selecting said maximum operational negative pressure level and said minimum operational negative pressure level.

17. The device as recited in claim 16 wherein said means for selecting includes means for programming said maximum operational negative pressure level and said minimum operational negative pressure level in said analyzing means.

18. The device as recited in claim 17 further comprising:

means for cushioning a rise in negative pressure levels in the system during a start-up period of the system wherein the pump is actuated and fluid begins to flow in the system, thereby preventing a surge of negative pressure in the system beyond said maximum operational negative pressure level caused by the initial movement of fluid through system.

19. A method for preventing entrapment of humans, animals and objects in a fluid transfer or fluid circulation system, wherein the fluid transfer or fluid circulation system includes at least one pump which draws water from a reservoir through one or more intake lines each extending from an open end at the reservoir and leading to an intake of the one or more pumps of the system;

the method comprising the steps of:

selecting a first operational range of negative pressure levels between a maximum operational negative pressure level and a minimum operational negative pressure level;

sensing negative pressure levels in the system;

establishing a second operational range of negative pressure levels each time the pump is activated to cause movement of water through the system, said second operational range defining a normal operating pressure window particular to the system;

analyzing the sensed negative pressure levels and comparing the sensed negative pressure levels to said first and second operational ranges;

stopping operation of the pump upon determining that a sensed negative pressure level has deviated outside of the first or second operational ranges; and simultaneously introducing positive pressure into the system and eliminating suction at the open ends thereof, upon determining that a sensed negative pressure level has deviated outside of the first or second operational ranges.

20. The device as recited in claim 19 further comprising the step of:

cushioning a rise in negative pressure levels in the system during a start-up period of the pump by intermittently introducing positive pressure into the system during the start-up period.

* * * * *